US009347152B2

(12) United States Patent
Fang et al.

(10) Patent No.: US 9,347,152 B2
(45) Date of Patent: May 24, 2016

(54) COMBINED FRICTIONAL FALSE TWISTING DEVICE FOR RING SPINNING FRAME

(75) Inventors: Lei Fang, Shanghai (CN); Deliang Zhang, Shanghai (CN); Linyao Wang, Shanghai (CN); Xihui He, Shanghai (CN); Wenhua Zhou, Shanghai (CN); Yun Song, Shanghai (CN); Shimin Liao, Shanghai (CN); Ziyi Dai, Shanghai (CN); Hongyan Lan, Shanghai (CN); Genda Hua, Shanghai (CN); Xiaoyan Wan, Shanghai (CN)

(73) Assignee: Shanghai Wool & Jute Textile Research Institute, Shanghai (CN)

( * ) Notice: Subject to any disclaimer, the term of this patent is extended or adjusted under 35 U.S.C. 154(b) by 168 days.

(21) Appl. No.: 14/117,201

(22) PCT Filed: Feb. 16, 2012

(86) PCT No.: PCT/CN2012/071193

§ 371 (c)(1),
(2), (4) Date: Nov. 12, 2013

(87) PCT Pub. No.: WO2013/063881

PCT Pub. Date: May 10, 2013

(65) Prior Publication Data

US 2015/0128555 A1 May 14, 2015

(30) Foreign Application Priority Data

Oct. 31, 2011 (CN) ..... 2011 1 0335819

(51) Int. Cl.

| | |
|---|---|
| ***D02G 1/08*** | (2006.01) |
| ***D02G 1/06*** | (2006.01) |
| ***D01H 7/92*** | (2006.01) |

(52) U.S. Cl.

CPC ..... *D02G 1/087* (2013.01); *D01H 7/923* (2013.01); *D02G 1/06* (2013.01); *D02G 1/082* (2013.01)

(58) Field of Classification Search

CPC ..... D02G 1/087; D01H 1/02; D01H 1/025; D01H 7/923

USPC ..... 57/75, 338–340

See application file for complete search history.

(56) References Cited

U.S. PATENT DOCUMENTS

| | | | | |
|---|---|---|---|---|
| 3,813,868 | A * | 6/1974 | Lorenz | 57/336 |
| 3,940,914 | A * | 3/1976 | Schuster | 57/339 |
| 3,973,383 | A * | 8/1976 | Yu | 57/339 |
| 3,973,384 | A * | 8/1976 | Yu | 57/339 |
| 3,994,123 | A * | 11/1976 | Sholly, Jr. | 57/264 |
| 4,771,598 | A * | 9/1988 | Scherpf | 57/290 |
| 5,794,429 | A * | 8/1998 | Overstrass et al. | 57/339 |
| 6,860,095 | B2 * | 3/2005 | Tao et al. | 57/75 |

(Continued)

*Primary Examiner* — Shaun R Hurley

(74) *Attorney, Agent, or Firm* — Ware, Fressola, Maguire & Barber LLP

(57) ABSTRACT

A frictional false twister is disclosed. The twister has a plurality of rotating friction plates located between the nip of the front rollers and the yarn guide. The friction plates are staggeringly arranged for rubbing a twisted yarn. The spinning direction of the twisted yarn is opposite to the rotating direction of the friction plates. Through the action of the frictional false twister, the twist of the yarn between the false twisting device to the front nip can be increased, shortening the twisting triangle height, and increasing the spinning strength. As the yarn and the outer surface of the friction plate make relative sliding and rubbing, the friction damping force correspondingly reduces the spinning tension in the twisting triangle.

18 Claims, 7 Drawing Sheets

(56) References Cited

U.S. PATENT DOCUMENTS 7,096,655 B2 * 8/2006 Tao et al. ..... 57/75
2005/0268591 A1 * 12/2005 Tao et al. ..... 57/75
2010/0024376 A1 * 2/2010 Tao et al. ..... 57/333
2012/0151894 A1 * 6/2012 Tao et al. ..... 57/75

* cited by examiner

COMBINED FRICTIONAL FALSE TWISTING DEVICE FOR RING SPINNING FRAME

TECHNICAL FIELD

The present invention relates to the field of textile industry and, more specifically, to a friction false twisting device for use in a ring spinning machine.

BACKGROUND OF INVENTION

Since 1830 when the traditional ring spinning machine was invented, more than 180 years has passed and the ring spinning machine has become the world's most widely used spinning main equipment. Spinning production capacity of China's textile industry has currently been more than 50% of the global total, and there are 120 million cotton spindles and about 4 million wool spindles.

Traditional ring spinning machine has a unique twist mechanism and the special structure of yarn spinning, resulting in soft and fluffy yarn, cannot be replaced by any new spinning technology.

However, with the development of the modern textile industry, people pay more attention to the inherent defects of the ring spinning machine. The prolonged production practice shows that the key technical bottlenecks of the ring spinning machine are the spinning end breakage and unevenness, and that the strength of the yarn in the twisting triangle area is less than the spinning tension, leading to the spinning end breakage and unevenness. Therefore, reducing the spinning tension while increasing the strength of the yarn is the preferred target task of the spinning field researchers.

Spinning tension is the force that is transmitted to the twisting triangle area by the sliver of the bottom of the ring spinning machine. The spinning tension is a composite force, and may change every moment.

Spinning tension is the algebraic sum of five variable forces: winding tension, the damping force of the bead ring, the centrifugal force of the air ring, ring board move additional dynamic tension and the yarn guide damping tension. The adverse consequences of excessive spinning tension acting on the twisting point are that the fibers in the yarn will slip and produce unexpected draft, making the yarn uneven and increasing snicks. Even the spinning end may break.

The spinning strength refers to the spinning strength in the twist triangle area. There are large differences in yarn strength. The strength of yarn depends on the fiber tensile strength, fiber length, curl roughness surface and the applied twist level. With the increase of the twist, the holding force of the fibers in the yarn will increase, and the yarn strength will also increase. Twist factor is not only a major factor but also a direct factor. Spinning strength is determined by the following factors: fiber breaking strength, fiber length, roller grip force, and twisting triangle width and height. Direct factor is the height of the twisting triangle, and twisting triangle height determines the roller nip holding the amount of fiber. When twisting triangle height is lower, more fibers can be controlled in the twisting triangle. Increasing the twist and torque is the most effective measure to reduce the twisting triangle height. There is a great difference between increasing spinning strength by increasing the twist and increasing yarn strength by increasing the twist. Increasing the yarn twist can increase the holding force of fibers, whereas increasing the twist of the twisting triangle can only reduce the twisting triangle height and increase the fibers held by the roller. According to relevant information, the spinning strength is very low, for example, the spinning strength of 28tex cotton yarn is about 90~150 cN. However the strength of yarn is about 400 cN. Therefore, increasing the spinning strength can prevent breakage and improve the sliver evenness. Increasing the twist in the twisting triangle is the most effective technical measure to improve the quality of yarn and prevent breakage, but it makes the fabric feel stiffer.

Because of the above defects of the ring spinning machine, application of the ring spinning machine is limited. If the spinning speed cannot be further increased and spindle speed remains about 15000 r/min, the traditional ring spinning machine cannot spun the yarn lower than 330 twists per meter, and that requires greater spinning fiber length and short fiber content.

For the defects regarding high spinning tension and low spinning strength of ring spinning machine, people continue to study and explore ways to improve. The current improvements are as follows:

(1) Using finger-shaped ingot end ingot spinning. The advantage of this technique is the spinning tension significantly being improved and it requires simple structure. The disadvantages are that the spinning strength does not increase but decreases, and the friction between the yarn and bobbin becomes more severe and produces more lint;

(2) Using the magnetic rotary yarn guide in place of the yarn guide. This can produce the false twist effect and the spinning twist can be transmitted to the front roller nip, and reduce the twisting triangle area. Spinning strength can be improved by about 20%, and spinning speed can also be improved by about 20%. The low-twist yarn can be spun. The disadvantages are the splicing operation being inconvenient, the high manufacturing cost of the yarn guide, and the low efficiency of false-twist.

(3) Chinese patent No. 201010237244.3 discloses a high-strength, low-tension spinning device, equipped with yarn tension damping needle holding the false twist. The advantages of this device are the lower spinning tension, and the improved spinning strength. The disadvantage is that the splicing operation is more inconvenient;

(4) Chinese patent No. 201110129873.9 discloses using a pair of the dust cages in the form of friction false twist for compact wet spinning. The advantages are the increased spinning strength, the reduced the spinning tension and a more convenient splicing operation. The disadvantage is that the suction of the dust cages motor needs more power;

(5) Chinese patent No. 02118588.3 proposes a method and apparatus to reduce spinning tension in spinning low twist yarn. The disadvantage is that the spinning strength cannot be improved. Using the provided fiber splitting mechanism, the amount of fiber held by roller decreases; the yarn evenness is deteriorated; snicks are increased; the efficiency of false-twist is lower and the splicing operation is inconvenient;

(6) U.S. Pat. No. 7,096,655 B2 is comparable with Chinese patent application 02118588.1 Except for having a more convenient operation, it has the same defects and problems.

SUMMARY OF THE INVENTION

The object of the invention is to provide a modular friction false twist device, which can overcome the above-described defects. It improves the ring spinning machine yarn twist distribution, improves spinning strength, and reduces spinning tension.

The present invention is implemented through the following technical measures: It uses a modular friction false twisting device in a ring spinning machine. The device is characterized in that: from the roller nip to the yarn guide in a ring spinning machine, along the direction of the length of the ring spinning machine, a rectangular cross section panel is provided, which is fixed via a mounting foot by the machine panel of the ring spinning machine; To each spinning spindle there is installed a set of frictional false twister, and each set of frictional false twister is constituted by three groups of frictional coupling elements. Each group of frictional coupling member has a mandrel and a friction plate. The three mandrels are separately fixed by two bearings on the rectangular cross-section panel in left center and right positions. Two or three friction plates are provided on the middle mandrel, and one or two friction plates is correspondingly provided on the left and right mandrels. The friction plates of the left and right mandrels are disposed on a same plane, while the friction plates of the middle mandrel are disposed against the friction plates of the right and left mandrels in a staggering but parallel fashion. The three mandrels are driven by a drive belt, which also drive the friction plates, thus achieving the false twist on the yarn by the cylindrical surface of the friction plates. The drive belt is driven by a motor on the machine panel in the front of the ring spinning machine.

The friction plate's thickness is 1~2 mm, and the outer diameter is 18~25 mm.

The outer peripheral surface of the friction plate is treated with reticulate knurling processing.

The present invention has the following technical advantage: it increases the yarn twist between the front roller nip and the false-twister, and subsequently reduces the twist of yarn between yarn guide and the false-twister, resulting in the reduction of the twisting triangle height. The amount of fiber held by the rollers increases and the yarn strength of spinning area improves. The yarn breakage also reduces, yarn evenness improves, and the spinning tension in the twisting triangular area, to some extent, is reduced by the damping measures in the frictional false twisting.

Figure 1:
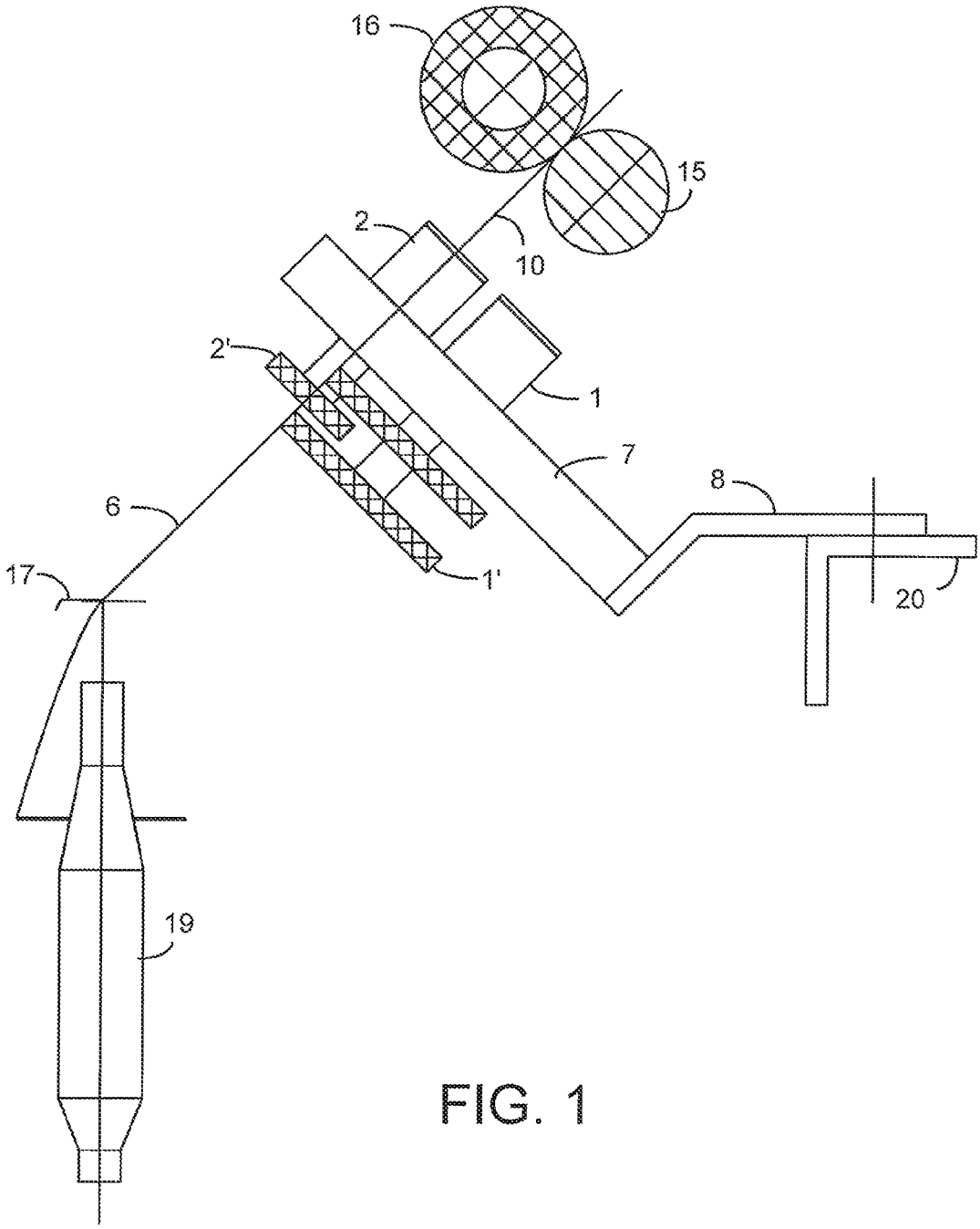
FIG. 1 is a side view of a cross section of a ring spinning machine, according to the present invention.
Figure 2:
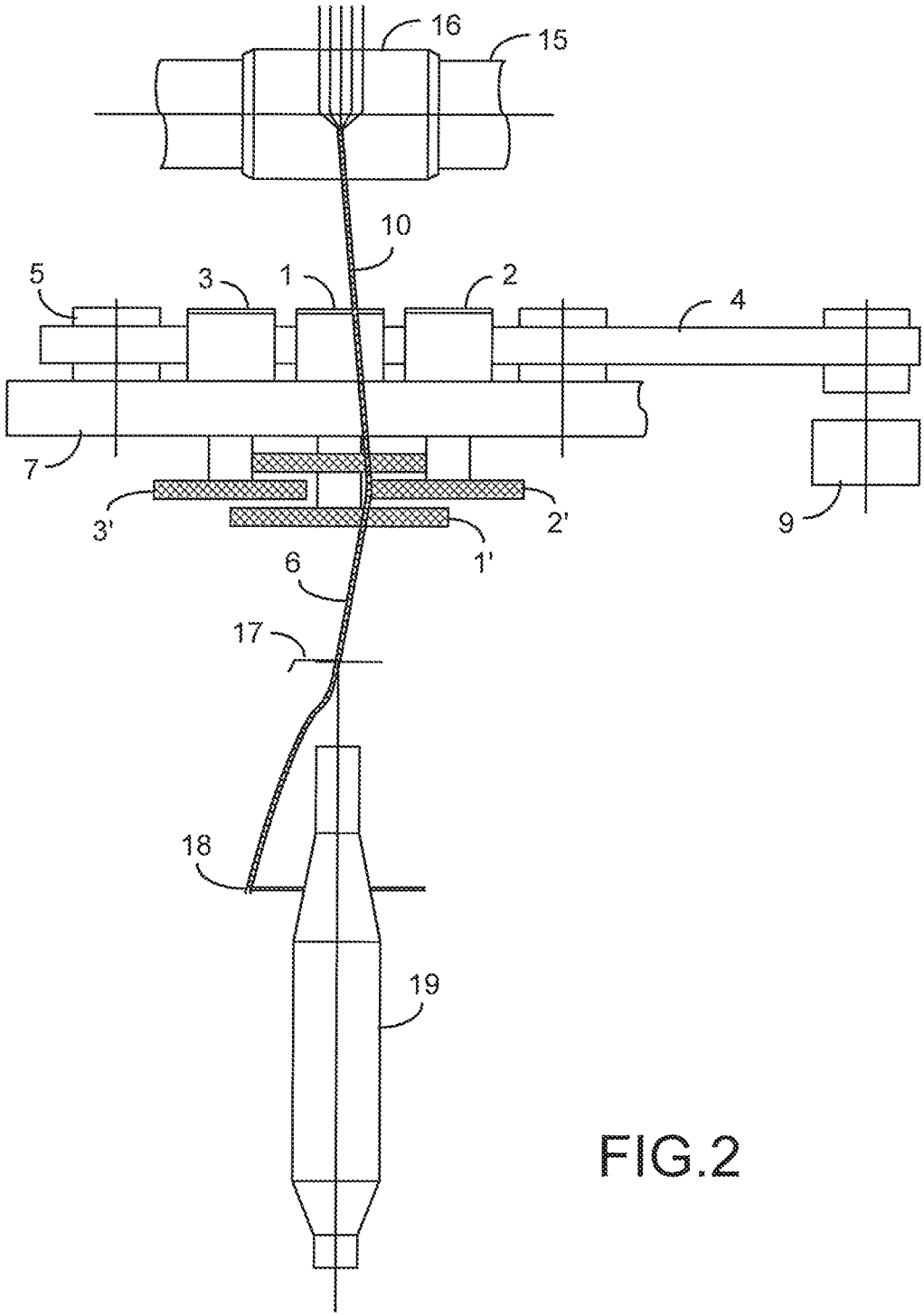
FIG. 2 is a front view of the ring spinning machine of the present invention.
Figure 3:
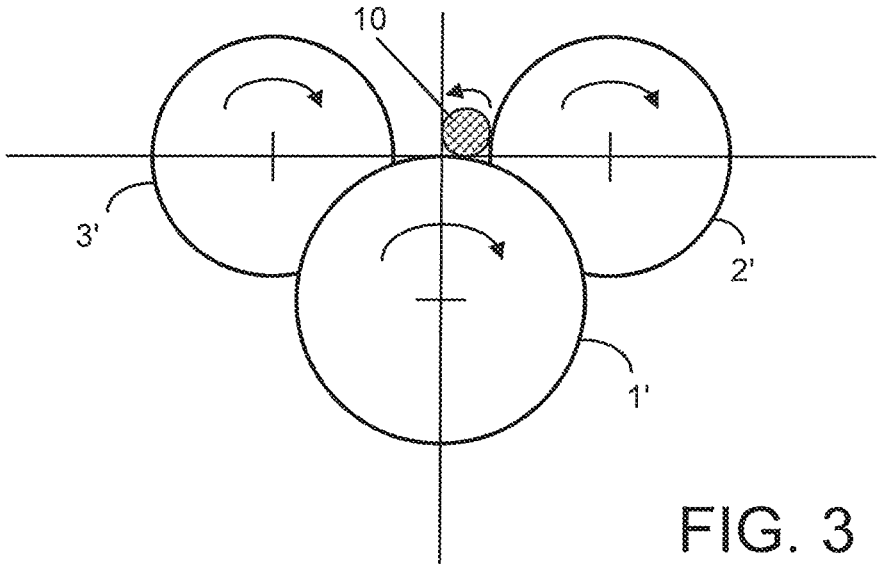
FIG. 3 is a schematic diagram of the false-twisting process, according to the present invention.
Figure 4:
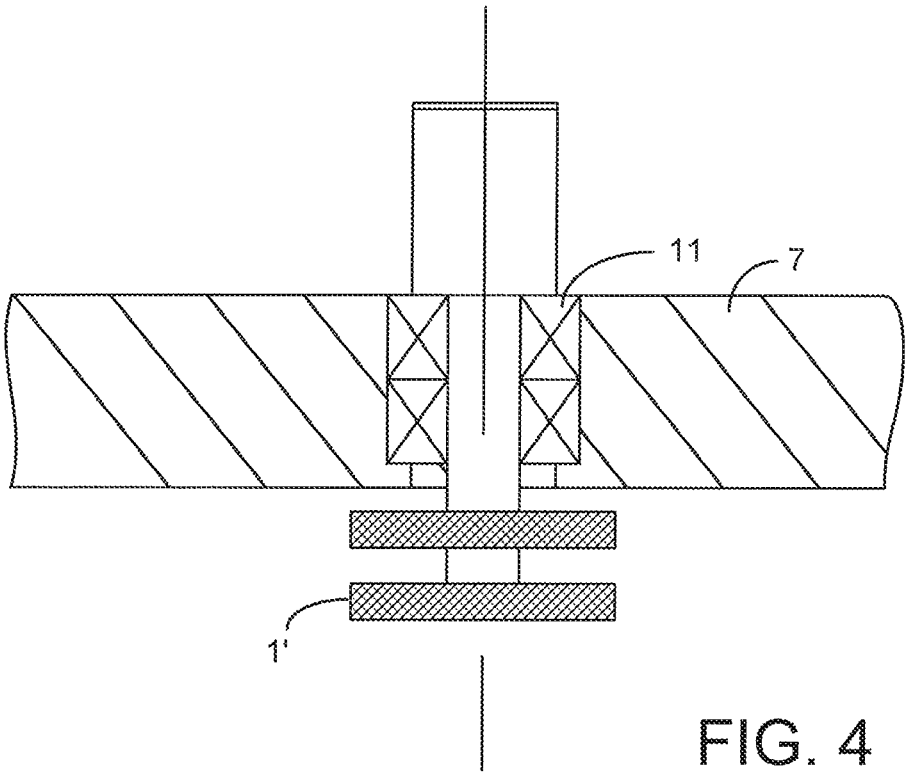
FIG. 4 is a schematic diagram of the mounting of a frictional coupling member.
Figure 5:
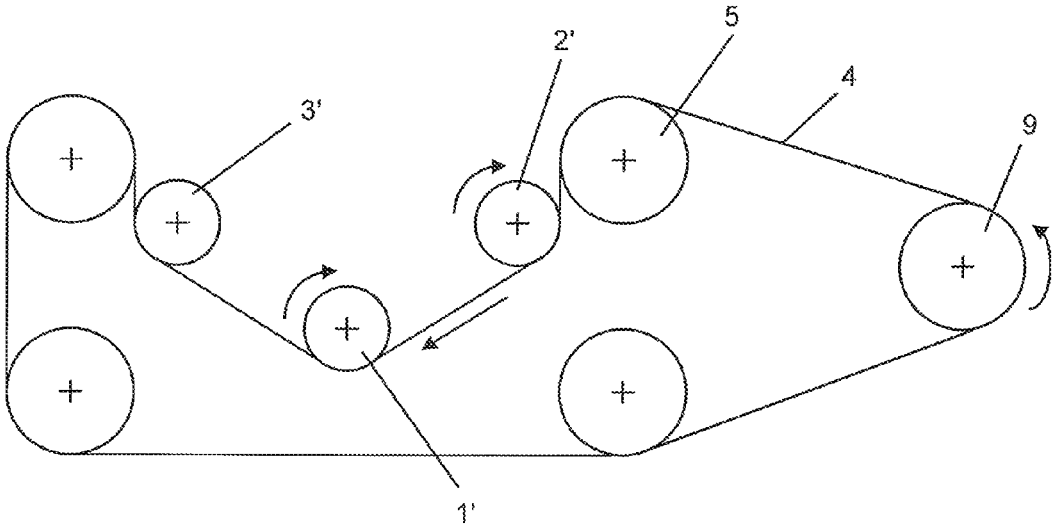
FIG. 5 shows the driving direction for spinning Z-twist yarns.
Figure 6:
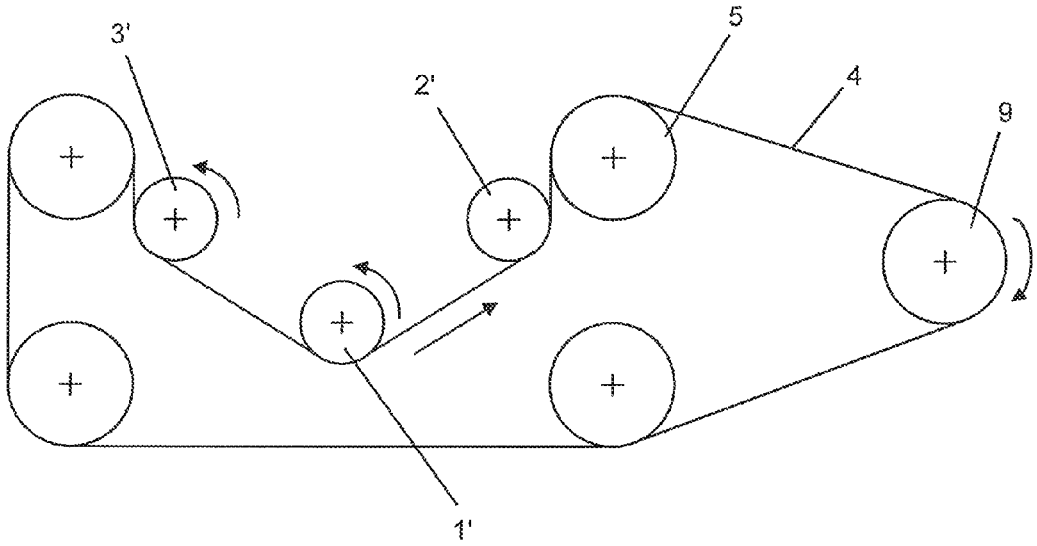
FIG. 6 shows the driving direction for spinning S-twist yarns.
Figure 7:
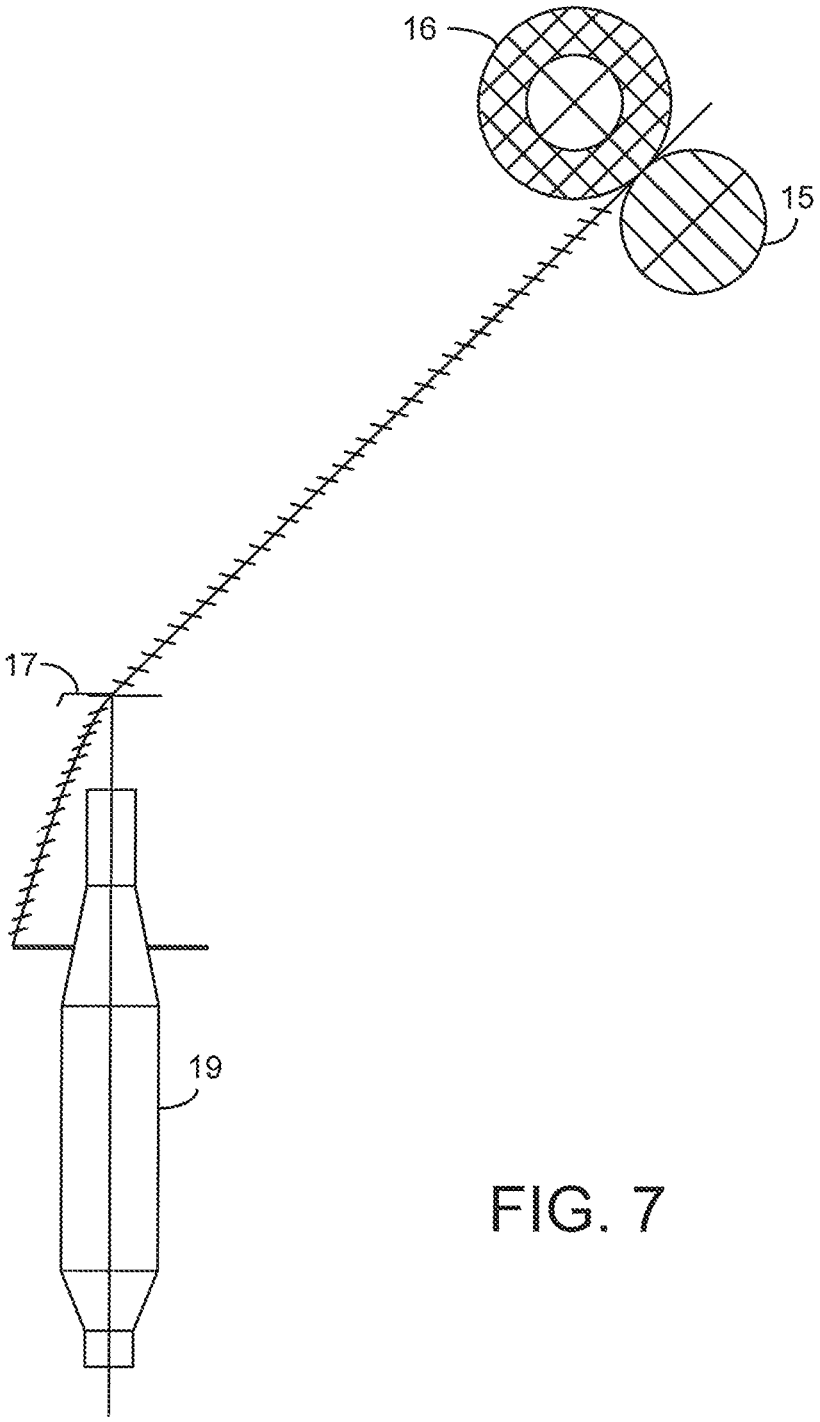
FIG. 7 is a schematic diagram of the conventional ring spinning frame showing the yarn twist by the yarn guide.
Figure 8:
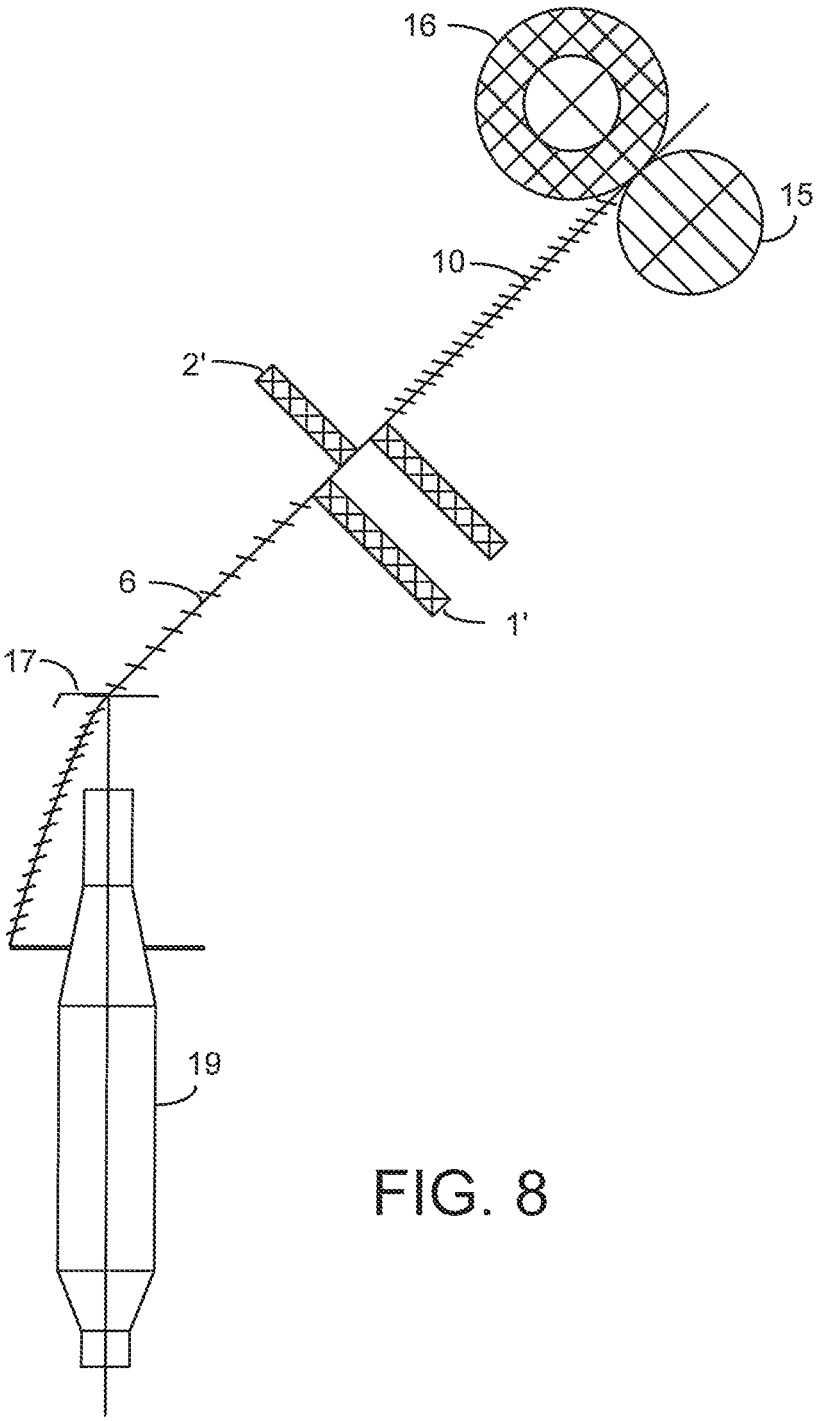
FIG. 8 is a twist distribution in the yarn using the present invention.

In the drawings: 1—middle mandrel; 1'—middle mandrel friction plate; 2—right mandrel; 2'—right mandrel friction plate; 3—left mandrel; 3'—left mandrel friction plate; 4—transmission belt; 5—tension pulley; 6—low twist sliver; 7—rectangular cross-section panel; 8—mounting feet; 9—drive motor; 10—high twist silver; 11—bearing; 15—front roller; 16—front rubber roller; 17—yarn guide; 18—bead ring; 19—yarn pipe; 20—machine panel.

Among the items shown in the drawings, items 1 to 11 are part of the present invention, and items 15-20 are part of an existing ring spinning frame.

DESCRIPTION OF THE EMBODIMENTS

As the yarn is outputted from the front nip of the front roller 15 and the front rubber roller 16 to the false twisting device, it is placed among the outer peripheral surfaces of the friction plates. The yarn is put through a yarn guide 17, and finally wound on a yarn pipe 19. When spinning Z-twist yarns, the yarn is rubbed by the middle mandrel friction plate 1' and right mandrel friction plate 2'. The friction plates 1' and 2' are rotated in the same clockwise direction, while the yarn rotates in the counter-clockwise rotation. When spinning S-twist yarns, the yarn is rubbed by the middle mandrel friction 1' and left mandrel friction plate 3'. The friction plates 1' and 3' are rotated in the same counter-clockwise direction, while the yarn rotates in the clockwise rotation.

Through the action of the frictional false twister, the twist of the yarn between the false-twist device and the front nip can be increased, thereby shortening the twisting triangle height and increasing the spinning strength. As the yarn and the outer surface of the friction plate make relative sliding and rubbing, the friction damping force correspondingly reduces the spinning tension in the twisting triangle.

Compared to the traditional ring spinning machine, this invention can reduce the spinning tension by about 36% and, at the same time, improve the spinning strength by about 15%-25%, and improve the spinning speed by 20%-30%. It can spin lower twist yarn than the traditional ring spinning machine, reduce design twist factor, reduce spinning residual torsional moment, and ultimately change the torsion deformation of the fabric and the vertical skew. It improves the fabric surface flatness and dyeing properties, and improves the feel of the fabric.

The device according to the present invention does not change the original structure of the ring spinning machine and it is suitable for retrofitting of old machine. The retrofitting cycle is short and the cost is low, suitable for the every enterprise.

With the increase of the number of friction plates and the roughness of the outer peripheral surface of the friction plate increased, the effect of the false twist will be improved. For example, the number of friction plate 1' can be increased to 4 plates, and each of the friction plate 2' and friction plate 3' can be correspondingly increased to 3.

What is claimed is:

1. A ring spinning apparatus, comprising:

a yarn guide;

a roller nip arranged to output a yarn toward the yarn guide, the yarn arranged to spin in a spinning direction; and a frictional false twisting device arranged to receive the yarn from the roller nip, wherein the frictional false twisting device comprises:

a plurality of friction plates, located between the roller nip and the yarn guide, each friction plate comprising a peripheral outer surface; and a movement mechanism arranged to rotate the friction plates in a rotating direction different from the spinning direction, wherein at least two of said plurality of friction plates are located adjacent to each other but on different planes and rotated about different axes such that a segment of the yarn between the roller nip and the yarn guide is arranged to rub against the peripheral outer surfaces of said at least two friction plates, wherein the plurality of friction plates are arranged to rotate about a first rotating axis, a second rotating axis and a third rotating axis, and wherein said at least two friction plates comprises a first friction plate arranged to rotate about the first rotating axis, and a second friction plate arranged to rotate about a second rotating axis, said plurality of friction plates further comprising a third friction plate arranged to rotate in the first rotating direction about the third rotating axis such that the second and third friction plates are located on a first plane and the first friction plate is located on a different second plane adjacent to the first plane, and wherein each of the second and third friction plates has a diameter, and the second rotating axis and third rotating axis is separated by a distance greater the diameter, and wherein the first friction plate is arranged such that the peripheral outer surface of the first friction plate is tangential to a plane passing through the second and third rotating axes.

2. The ring spinning apparatus according to claim 1, further comprising a plurality of mandrels, each of the mandrel having a shaft for mounting a different one of said plurality of friction plates for rotation, wherein the movement mechanism comprises a driving belt configured to rotate said plurality of mandrels in the rotating direction.

3. The ring spinning apparatus according to claim 2, further comprising a support panel arranged for mounting said plurality of mandrels between the roller nip and the yarn guide.

4. The ring spinning apparatus according to claim 3, wherein the support panel having a first side and an opposing second side such that said plurality of mandrels are located on the first side and said plurality of frictional plates are located on the second side.

5. The ring spinning apparatus according to claim 4, wherein the first side of the support panel is facing the nip and the second side of the support panel is facing the yarn guide.

6. The ring spinning apparatus according to claim 3 wherein the ring spinning machine comprises a frame and wherein the support panel is fixedly mounted on the frame via a mounting bracket.

7. The ring spinning apparatus according to claim 1, wherein said at least two of said plurality of friction plates are arranged to rotate in a clockwise direction and the yarn is arranged to spin in a counter-clockwise direction.

8. The ring spinning apparatus according to claim 1, wherein said at least two of said plurality of friction plates are arranged to rotate in a counter-clockwise direction and the yarn is arranged to spin in a clockwise direction.

9. A frictional false twisting device, comprising:

a plurality of friction plates located between a roller nip and a yarn guide, each friction plate comprising a peripheral outer surface, wherein the roller nip is arranged to output a yarn toward the yarn guide, the yarn is arranged to spin in a spinning direction; and a movement mechanism arranged to rotate the friction plates in a rotating direction different from the spinning direction, wherein at least two of said plurality of friction plates are located adjacent to each other but on different planes and rotated about different axes such that a segment of the yarn between the roller nip and the yarn guide is arranged to rub against the peripheral outer surfaces of said at least two friction plates, wherein the plurality of friction plates are arranged to rotate about a first rotating axis, a second rotating axis and a third rotating axis, and wherein said at least two friction plates comprises a first friction plate arranged to rotate about the first rotating axis, and a second friction plate arranged to rotate about a second rotating axis, said plurality of friction plates further comprising a third friction plate arranged to rotate in the first rotating direction about the third rotating axis such that the second and third friction plates are located on a first plane and the first friction plate is located on a different second plane adjacent to the first plane.

10. The frictional false twisting device according to claim 9, wherein each of the second and third friction plates has a diameter, and the second rotating axis and third rotating axis is separated by a distance greater the diameter, and wherein the first friction plate is arranged such that the peripheral outer surface of the first friction plate is tangential to a plane passing through the second and third rotating axes.

11. A method of frictional false twisting for use in a ring spinning machine, the ring spinning machine comprises a roller nip for outputting a yarn toward a yarn guide, the yarn arranged to spin in a spinning direction; said method comprising:

providing a plurality of friction plates between the roller nip and the yarn guide, each friction plate comprising a peripheral outer surface, wherein at least two of said plurality of friction plates are located adjacent to each other but on different planes and rotated about different axes;

rotating the friction plates in a rotating direction different from the spinning direction; and causing the yarn to rub against the peripheral outer surfaces of at least two of said plurality of friction plates.

12. The method according to claim 11, further comprising providing a plurality of mandrels, each of the mandrel having a shaft for mounting a different one of said plurality of friction plate for rotation; and arranging a moving driving belt to spin the plurality of mandrels for said rotating.

13. The method according to claim 12, wherein the plurality of mandrels are mounted on a support panel between the roller nip and the yarn guide, and wherein the support panel having a first side and an opposing second side such that said plurality of mandrels are located on the first side facing the nip and said plurality of frictional plates are located on the second side facing the yarn guide.

14. The method according to claim 11, wherein said at least two of said plurality of friction plates are arranged to rotate in a clockwise direction and the yarn is arranged to spin in a counter-clockwise direction.

15. The method according to claim 11, wherein said at least two of said plurality of friction plates are arranged to rotate in a counter-clockwise direction and the yarn is arranged to spin in a clockwise direction.

16. The method according to claim 11, wherein the plurality of friction plates are arranged to rotate about a first rotating axis, a second rotating axis and a third rotating axis, and wherein said at least two friction plates comprises a first friction plate arranged to rotate about the first rotating axis, and a second friction plate arranged to rotate about a second rotating axis, said plurality of friction plates further comprising a third friction plate arranged to rotate in the rotating direction about the third rotating axis such that the second and third friction plates are located on a first plane and the first friction plate is located on a different second plane adjacent to the first plane.

17. The method according to claim 16, wherein each of the second and third friction plates has a diameter, and the second rotating axis and third rotating axis is separated by a distance greater the diameter, and wherein the first friction plate is arranged such that the peripheral outer surface of the first friction plate is tangential to a plane passing through the second and third rotating axes.

18. The apparatus according to claim 2, further comprising:

an endless belt arranged to simultaneously spin said plurality of mandrels in a same direction so as to cause the mandrels to rotate the plurality of friction plates.

* * * * *